US007698753B2

(12) United States Patent
Jones et al.

(10) Patent No.: US 7,698,753 B2
(45) Date of Patent: Apr. 20, 2010

(54) SINK SETTING SYSTEMS FOR OFFSET AND OTHER SINKS

(76) Inventors: Thomas M. Jones, 17712 Gothard St., Unit B, Huntington Beach, CA (US) 92647; E. Wayne Lytle, 17712 Gothard St., Unit B, Huntington Beach, CA (US) 92647

( * ) Notice: Subject to any disclaimer, the term of this patent is extended or adjusted under 35 U.S.C. 154(b) by 585 days.

(21) Appl. No.: 11/677,424

(22) Filed: Feb. 21, 2007

(65) Prior Publication Data

US 2008/0196158 A1 Aug. 21, 2008

(51) Int. Cl.
*A47K 1/05* (2006.01)

(52) U.S. Cl. ..... 4/643; 248/201; 248/298.1

(58) Field of Classification Search ..... 4/630, 4/631, 633, 634, 640, 643, 647, 648; 248/146, 248/149, 201, 298.1, 312.1; 312/228; D23/290
See application file for complete search history.

(56) References Cited

U.S. PATENT DOCUMENTS 653,986 A * 7/1900 Conderman ..... 4/648
1,740,553 A 12/1929 Schmiedeknecht
2,429,455 A 10/1947 Dellon
2,809,002 A 10/1957 Rudolph
2,933,549 A * 4/1960 Antonucci ..... 248/298.1 X
3,425,655 A 2/1969 Cogdill
4,088,290 A 5/1978 Novello
4,122,762 A 10/1978 Williams
4,432,106 A 2/1984 Smith
5,386,959 A 2/1995 Laughlin et al.
5,505,419 A 4/1996 Gabrius
5,538,206 A * 7/1996 Sather ..... 4/643 X
5,743,501 A 4/1998 Rapp
D467,650 S * 12/2002 Ris ..... D23/290
D504,716 S * 5/2005 Bayer et al. ..... D23/290
7,429,021 B2 * 9/2008 Sather et al. ..... 4/633 X

FOREIGN PATENT DOCUMENTS

WO WO 02/098267 A2 12/2002

* cited by examiner

*Primary Examiner*—Robert M Fetsuga
(74) *Attorney, Agent, or Firm*—Larry K. Roberts

(57) ABSTRACT

A sink setting cross-member supports a non-linear sink support surface relative to a support structure. In an exemplary embodiment, the cross-member includes a first bracket portion at a first bracket end, and a second bracket portion at a second bracket end. A support portion is disposed between the first bracket portion and the second bracket portion.

22 Claims, 6 Drawing Sheets

SINK SETTING SYSTEMS FOR OFFSET AND OTHER SINKS

BACKGROUND

Installation of sinks in counters used in kitchens, bathrooms and other facilities can be time consuming. The different sink sizes and sink types available to the homeowner or commercial user today present challenges in efficiently mounting the sinks. The difficulties may be exacerbated by sinks with non-linear mounting edges.

SUMMARY OF THE DISCLOSURE

A sink setting cross-member supports a sink support surface relative to a support structure. In an exemplary embodiment, the cross-member includes a first bracket portion at a first bracket end, and a second bracket portion at a second bracket end. A support portion is disposed between the first bracket portion and the second bracket portion.

BRIEF DESCRIPTION OF THE DRAWINGS

Features and advantages of the disclosure will readily be appreciated by persons skilled in the art from the following detailed description when read in conjunction with the drawing wherein.

DETAILED DESCRIPTION

Figure 1:
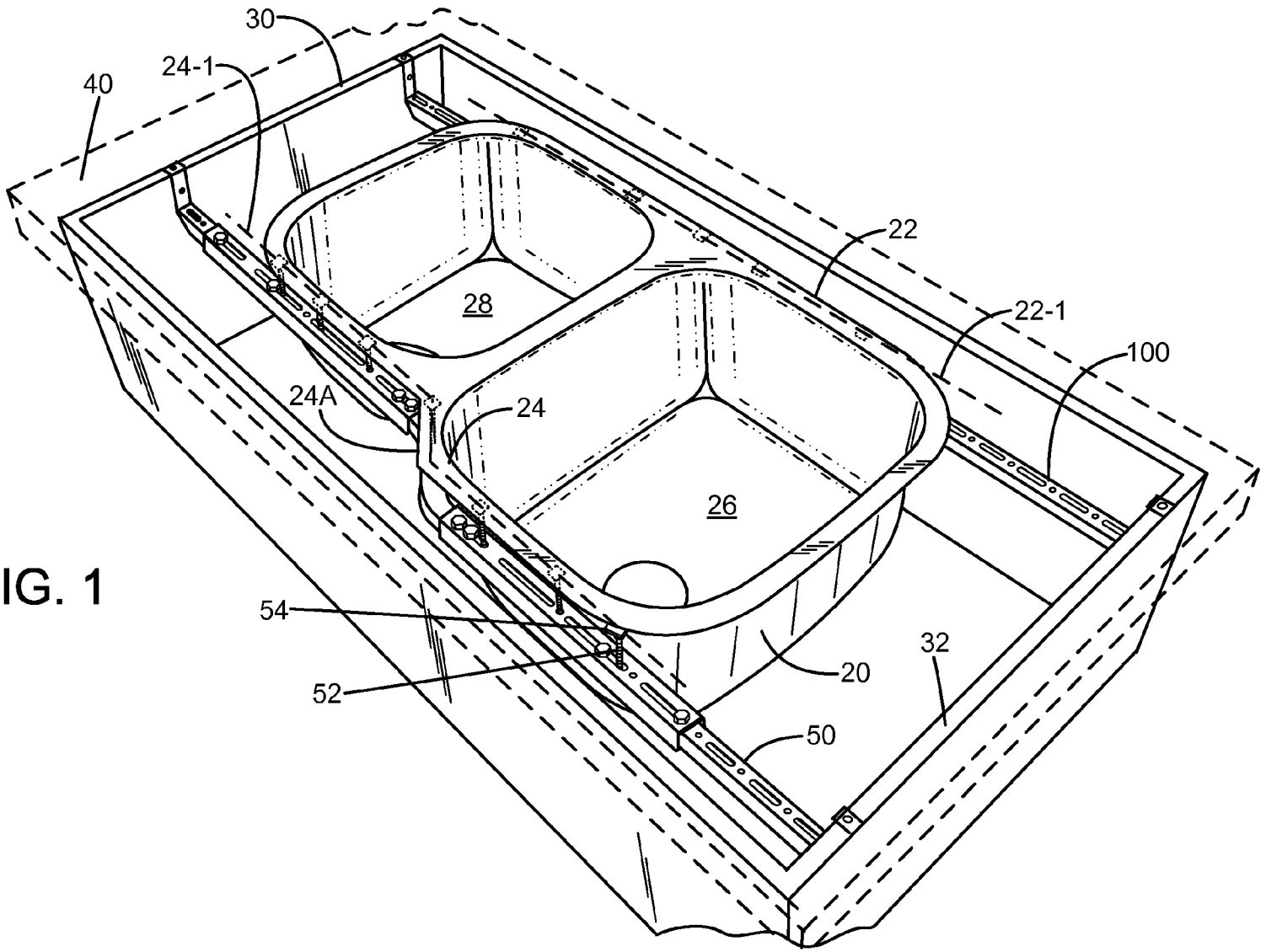
FIG. 1 is an isometric view of an exemplary embodiment of an application of a sink support system to support an offset double sink in a counter.
Figure 2:
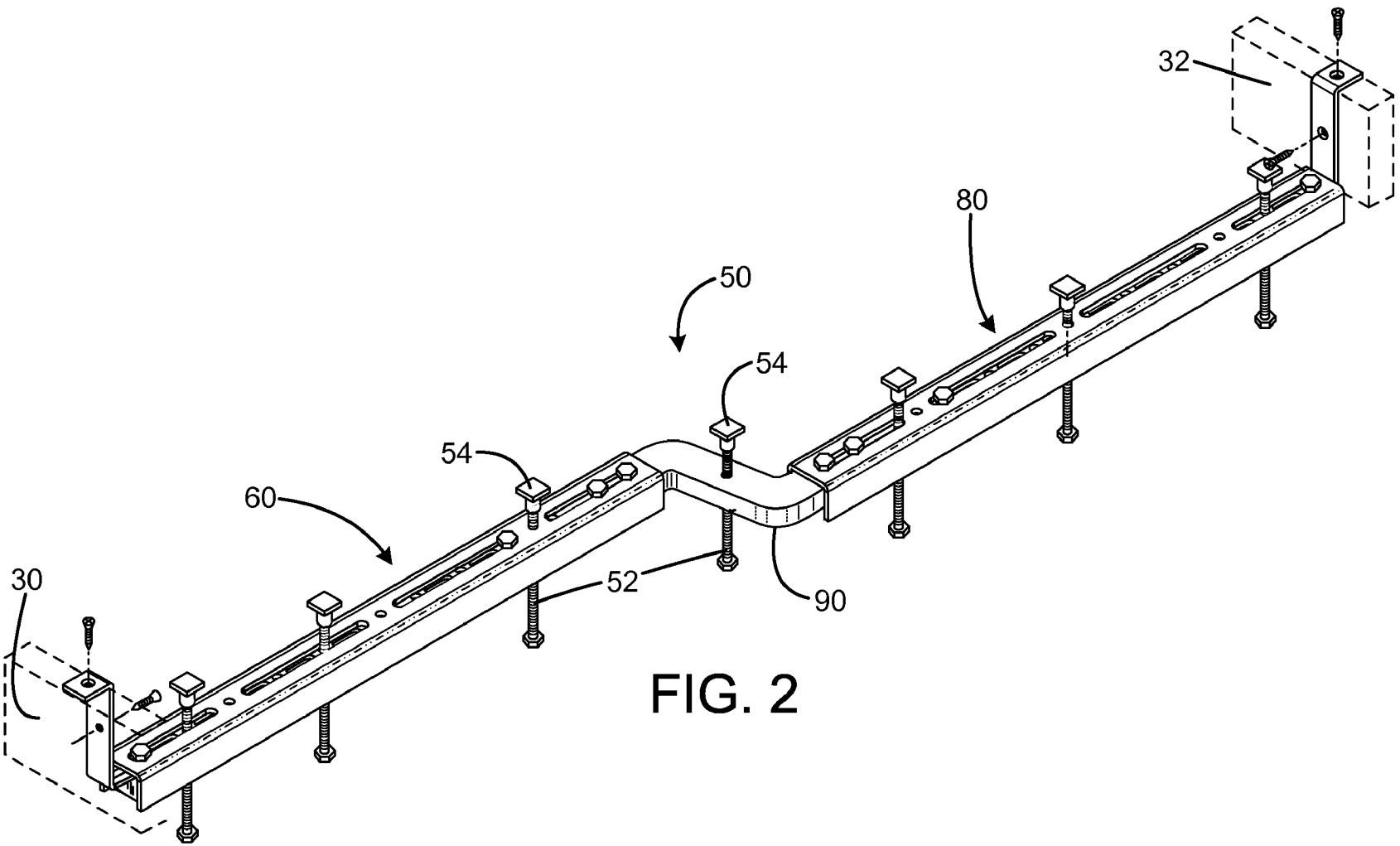
FIG. 2 is an isometric view of an exemplary embodiment of a cross member bracket.

In the following detailed description and in the several figures of the drawing, like elements are identified with like reference numerals. The figures are not to scale, and relative feature sizes may be exaggerated for illustrative purposes.

An exemplary embodiment of a sink setting system is depicted in an exemplary double sink installation in FIG. 1. The system includes two support cross-members 50, 100 which are positioned on opposite sides of a double steel sink 20. The sink 20 may be fabricated of stainless steel, for example, and in this example, the sink has opposed mounting edges or lips 22, 24. Mounting edge 22 extends along a linear edge profile 22-1, and may be supported by support cross-member 100. The mounting edge 24 however extends along a non-linear edge profile 24-1. The mounting edge 24 follows the edges of sink basins 26, 28. Basin 28 is shorter or of lesser depth (front to back) than basin 26. The non-linearity of the edge 24 presents difficulties in supporting the double sink 20.

The cross-members 50, 100 are attached to structural supports 30, 32, which in an exemplary embodiment may be cabinet walls. The cross-member 100 may be a telescoping cross-member, which is adjustable in length to accommodate sinks of different sizes. One exemplary type of cross-member suitable for the purpose is described in application Ser. No. 11/549,924, filed Oct. 16, 2006, now U.S. Pat. No. 7,429,021. Another exemplary cross-member suitable for use as cross-member 100 is described in U.S. Pat. No. 5,538,206. Other cross-support devices may alternatively be employed which employ fixed length, non-telescoping structures or telescoping structures. Exemplary embodiments of a cross-member 50 for supporting the sink along a nonlinear edge are described more fully below.

The sink 20 may be supported by a plurality of leveling bolts 52 and associated end caps 54 which are assembled to the respective cross-members 50, 100. After the sink is positioned on the leveling bolts, in an exemplary application, a countertop 40 (illustrated in phantom in FIG. 1) may be positioned over the cabinet with a sink opening formed therein.

FIGS. 2-6 illustrate an exemplary embodiment of a cross-member 50. The cross-member in one exemplary embodiment includes first and second telescoping bracket structures 60 and 80, each forming a linear bracket structure portion, and a connector structure 90. Each of the bracket structures 60 and 80 includes an upper channel member and a lower channel member. The structures 60 and 80 may be fabricated in the same manner, although not necessarily of different lengths. In an exemplary embodiment, the structures 60 and 80 may be of the same length. In another exemplary embodiment, one of the structures 60, 80 may be shorter than the other, to accommodate smaller sink rough opening dimensions. Because of the similarity in construction, only structure 60 is described in detail below.

An exemplary embodiment of a bracket structure 60 may include telescoping lower and upper longitudinal channel members 60-1 and 60-2. In an exemplary embodiment, the longitudinal members are each of a generally U-shaped construction. In other embodiments, the bracket structures 60, 80 may be of a fixed, non-telescoping length, and may be fabricated as a unitary one-piece structure. The lower channel member 60-1 has a bracket 60-1A formed at one end thereof, to provide an attachment means for attaching the bracket assembly to a support structure such as support structure 30. In this exemplary construction, member 60-1 is formed with web portion 60-1B connecting leg portions including lea portion 60-1C. Similarly member 60-2 is formed with web portion 60-2B connecting leg portions 60-20, 60-2D. The web portion 60-2B of the upper member 60-2 is wider than the web portion 60-1B of the lower member 60-1, to allow the lower member to nest inside the upper member.

In an exemplary embodiment, structure 60 has an attachment bracket portion 60-1A formed at one end thereof, adapted for attaching the structure to a support structure 30. The bracket portion 60-1A may be integrally formed with the web portion 60-1B, so that vertical portion 60-1A-1 is bent or formed at a right angle relative to the web portion. The distal end 60-1A-2 of the portion 60-1A may be bent or formed at a right angle relative to portion 60-1A-1 to provide a support area for positioning against the support structure, with holes formed in the portions 60-1A-1 and 60-1A-2 to receive threaded fasteners.

The bracket structures 60 and 80 in an exemplary non-limiting embodiment may be fabricated from cold rolled steel; the steel may have a zinc coating applied for corrosion protection. An exemplary thickness of the steel may be 3/16 inch. Other materials and/or thicknesses may alternatively be employed.

In an exemplary embodiment, each channel member 60-1 and 60-2 has an alternating pattern of slots and threaded openings formed in the web portion. The respective patterns may be selected to provide a relatively high degree of adjustability in the length of the assembly of members 60-1 and 60-2, while providing relatively close spacing of positions for leveling bolts over a broad range of assembly lengths.

Figures 3, 4:
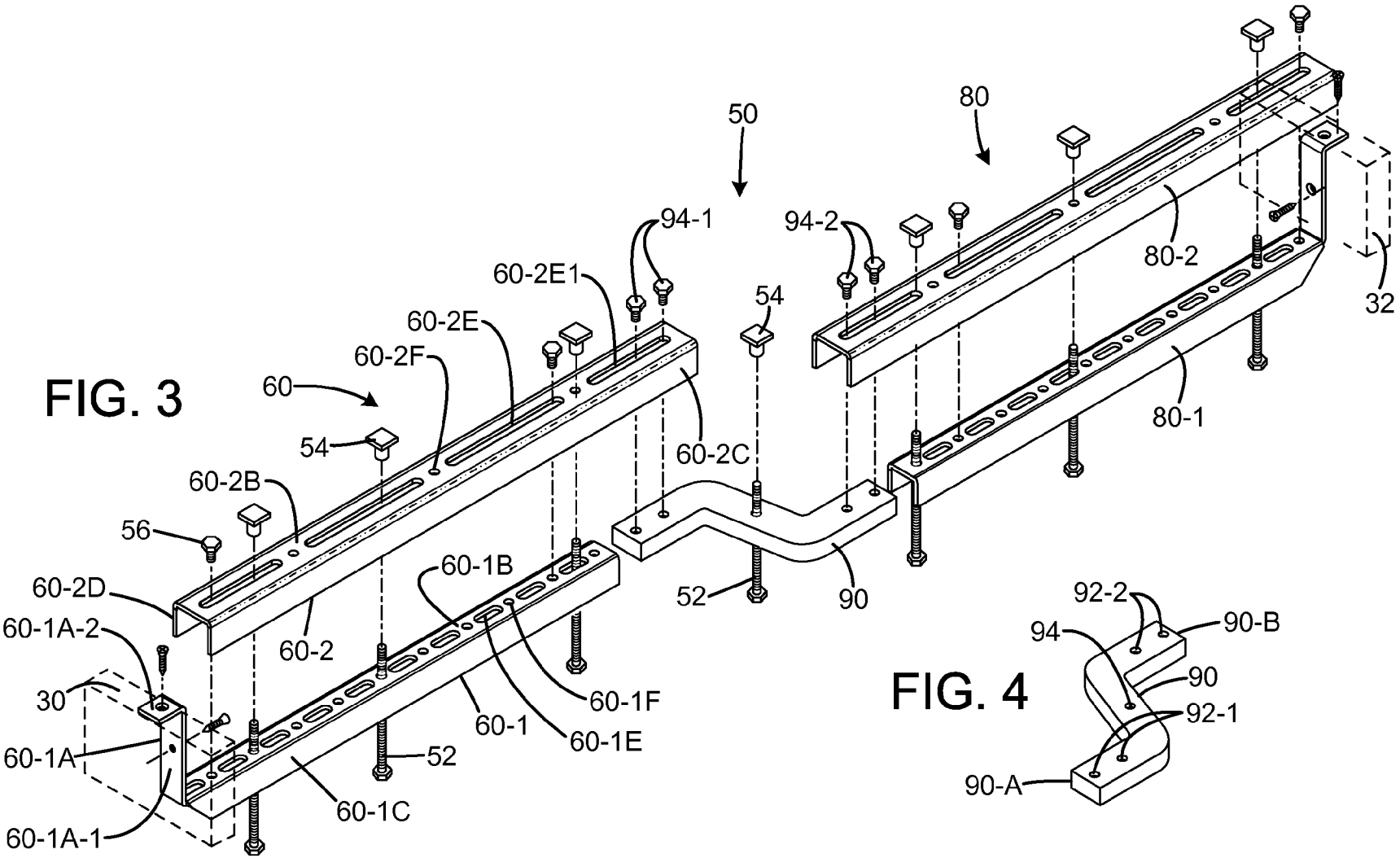
FIG. 3 is an isometric exploded view of the cross member bracket of FIG. 2.
FIG. 4 is an isometric view of an exemplary embodiment of an offset connector structure for a cross member bracket.
Figure 5:
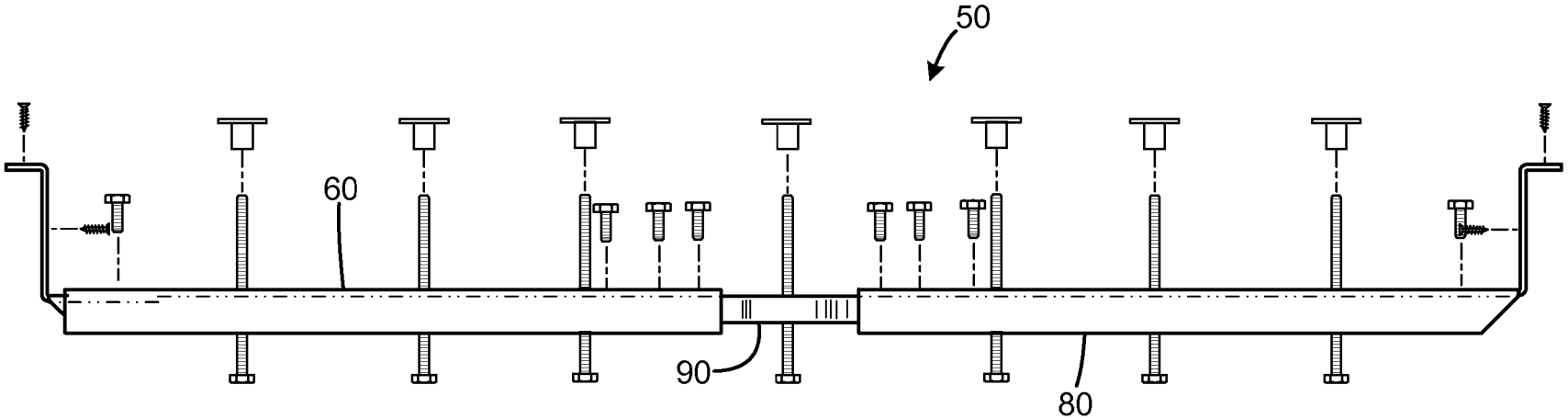
FIG. 5 is a side view of an exemplary embodiment of a cross member bracket.
Figure 6:
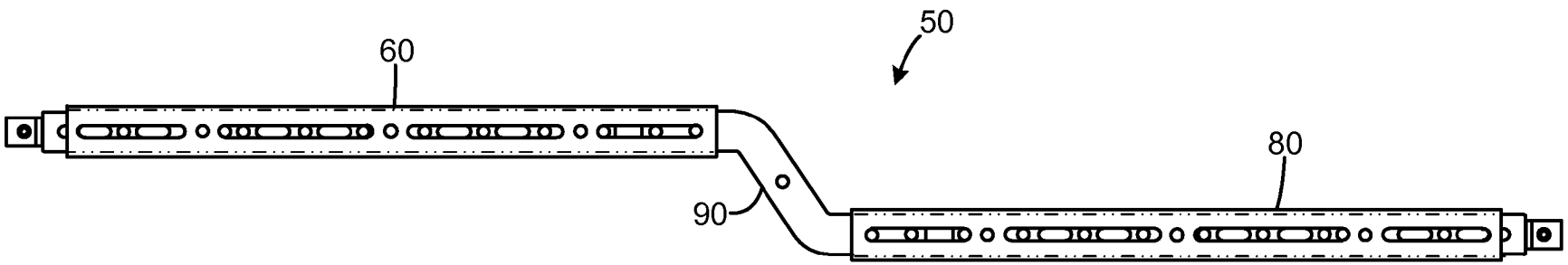
FIG. 6 is a top view of an exemplary embodiment of a cross member bracket.

FIG. 3 illustrates an exemplary embodiment in which the upper member 60-2 has a plurality of slots 60-2E formed along its longitudinal extent, alternating with threaded bores 60-2F. The lower member 60-1 has a plurality of slots 60-1E formed along its longitudinal extent, alternating with threaded bores 60-1F. In an exemplary embodiment, the bores 60-1F and 60-2F may be of the same diameter and thread size. The slots 60-1E and 60-2E are sized to allow the leveling bolts 52 to pass through, and the threaded bores 60-1F and 60-2F are sized to threadingly accept the threaded leveling bolts 52. Thus, a leveling bolt 52 may be threaded into either a bore 60-1F or a bore 60-2F in a sink supporting position, and may be inserted through either a slot 60-1E in member 60-1 or a slot 60-2E in member 60-2, or in some positions, will not be inserted through a slot in either member.

In an exemplary embodiment, the threaded holes may be formed by extrusion or punching holes and tapping the holes to form the threads. Alternatively, the holes may be formed by drilling and tapping. Other techniques may be used to provide a female threaded fastener to engage the leveling bolts, e.g. nuts attached, e.g. by welding, pressing (as in PIM nuts), brazing or soldering, to surfaces of the channel members in alignment with holes formed in the channel members. Preferably, the female threaded fasteners are positioned so as not to interfere with the relative movement of the channel members 60-1, 60-2 along their range of movement. This may facilitate an extended range of adjustment positions.

In an exemplary embodiment, in which the threaded holes are formed by extrusion or punching, the material surrounding the opening may protrude above or below the surface of the web portion, depending on the direction of the extrusion or punching. In this way, the protruding portions of the threaded fastener structures do not interfere with the sliding fit of the members 60-1, 60-2.

Each leveling bolt 52 may have an end cap 54 positioned on its distal end to provide a flat cap surface to bear against the lower surface of a mounting lip or surface of a sink. An exemplary embodiment of an end cap 54 may have an interior hollow or open region which receives the end of the leveling bolt 52, and a dimple region to bear against the end of the bolt, reducing friction when the bolt is turned. The cap includes a top planar surface which bears against the underside of the rim of the sink; in an exemplary embodiment, the cap surface is about 3/4 inch by 3/4 inch in size, with rounded corners to reduce marring of sink surfaces in the event the cap turns with the leveling bolt. In an exemplary embodiment, the corners of the cap may be formed with a 1/8 inch radius. An edge of the cap may be set close to the sink and prevented from turning by the sink.

In an exemplary embodiment, a set of the slots 60-2E in the upper member 60-2 have a slot length L1 which is larger than a slot length L2 of a set of the slots 60-1E in the lower member 60-1. This provides an extended exposure of the threaded bores 60-1F in the lower member through the longer slots in the upper member. Slots adjacent the ends of the member 60-2 may have lengths different from L1 or L2. In an alternate embodiment, a set of slots in the lower member may have a longer longitudinal extent than a set of slots in the upper member.

It will be appreciated that the support members 60-1 and 60-2 may be fabricated of various lengths to accommodate larger variations in sink installations. For example, in one exemplary embodiment, the lower member 60-1 may have a length of 12 inches and upper member 60-2 may have a length of about 13 1/2 inches, with dimension L1 about 3 1/4 inch, and dimension L2 about 1 1/4 inch. This may provide a length adjustment range for the assembly 50. The web portions in this example may have a width of 1 1/16 inch for member 60-2 and 7/8 inch for member 60-1, with leg portion lengths of 3/4 inch for member 60-2 and 5/8 inch for member 60-1. In one exemplary embodiment, the lower and upper channel members 80-1 and 80-2 of the bracket structure 80 may be fabricated with similar dimensions. In an exemplary alternate embodiment, the lower and upper channel members 80-1 and 80-2 may be shorter than the members 60-1 and 80-1, to accommodate smaller rough openings for the sink installation.

In an exemplary embodiment, the slot and threaded bore patterns in the upper and lower channel members are adapted to provide a capability of positioning leveling bolts in a relatively closely spaced relationship. While some sink setting applications may not need such a distributed supporting arrangement along the edge of the sink, other applications may benefit from such an arrangement. Steel sinks for example have some relative flexibility of the sink along its edge, and may be held more securely in place by a system of relatively closely spaced leveling bolts and caps, e.g. including three, four or even more leveling bolts. Cast iron sinks are relatively rigid, and may be supported in some installations by fewer leveling bolts along an edge, e.g. two leveling bolts.

The channel members 60-1 and 60-2 may each be secured together at respective selected positions within their adjustment ranges. In an exemplary embodiment, the members may be fixed in position by threaded fasteners 56, which may be passed through a slot 60-2E in the upper channel member 60-2 and threadingly received in a threaded hole 60-1F in the lower member 60-1, and tightened in place so that the cap of the threaded fastener bears against the surface of the upper channel member 60-2. Alternatively, to provide additional flexibility for placement of a leveling bolt, the fasteners 56 may be inserted through overlapping slots in the upper and lower members, and secured with a nut. In an exemplary embodiment, the fasteners 56 and leveling bolts 52 are the same outer diameter dimension and thread size so that the fasteners and bolts may each be threadingly received in a threaded hole 60-1F or 60-2F.

In an exemplary embodiment, the leveling bolts 52 may have an outer diameter of 1/4 inch and a length of 3 1/2 inches. The fasteners 56 may have an outer diameter of 1/4 inch and a length of 3/4 inch.

In an exemplary embodiment, the bracket structures 60 and 80 are joined together by a connector structure 90, forming a support portion or support structure with attachment bracket portions at each end. The connector structure 90 may be a non-linear structure in an exemplary embodiment, to conform to a non-linear contour in a mounting surface of a sink, for example. For the sink example depicted in FIG. 1, the mounting lip 24 follows a jog or non-linear portion 24A. Of course, there may be other non-linear forms which may be addressed by appropriate design of the connector structure 90.

In another embodiment, the cross-member 50 may be fabricated of a unitary construction, in a fixed length, wherein the non-linear connector 90 and the bracket structures 60, 80 are of one piece construction. This may simplify fabrication and reduce cost, although in this case the flexibility in length adjustment may not be provided.

Means are provided for attaching respective ends of the connector structure 90 to the respective bracket structures 60, 80. In an exemplary embodiment, the attachment means may include threaded holes 92-1 and 92-2 formed in the connector structure, for receiving threaded fasteners 94-1 and 94-2. The fasteners may be inserted through slots formed in the upper channel members and tightened to secure the bracket structures to the connector structure. For example, ends of fasteners 94-1 may be inserted through slot 60-2E1 in the upper channel member 60-2 and received in threaded holes 92-1 in the connector structure 90.

The connector structure 90 in some embodiments may include a threaded hole 94 (FIG. 4) for receiving a mounting bolt 52 and supporting a cap 54 in supporting engagement with an underside of a sink mounting lip surface. In other embodiments, a connector structure may not include a hole for receiving a mounting bolt.

The connector structure 90 in an exemplary embodiment may be formed of cold rolled steel, although other materials with suitable rigidity and strength may be employed. For one exemplary application, the structure 90 may be fabricated as a unitary one piece structure, e.g. ⅜ inch thick and ⅞ inch wide. The exemplary embodiment depicted in FIG. 4 may be used in either sense or direction, i.e. to connect the connector end 90-A to bracket structure 60 and 90-B to bracket structure 80, or vice versa, with end 90-A connected to structure 80 and end 90-B connected to structure 60. This will allow the same connector structure 90 to be used for either the case with a smaller sink basin 28 on the left side of larger sink basin 26, as in FIG. 1, or the case with a smaller sink basin 28 on the right side of larger sink basin 26.

Figures 7, 8, 9, 10, 11:
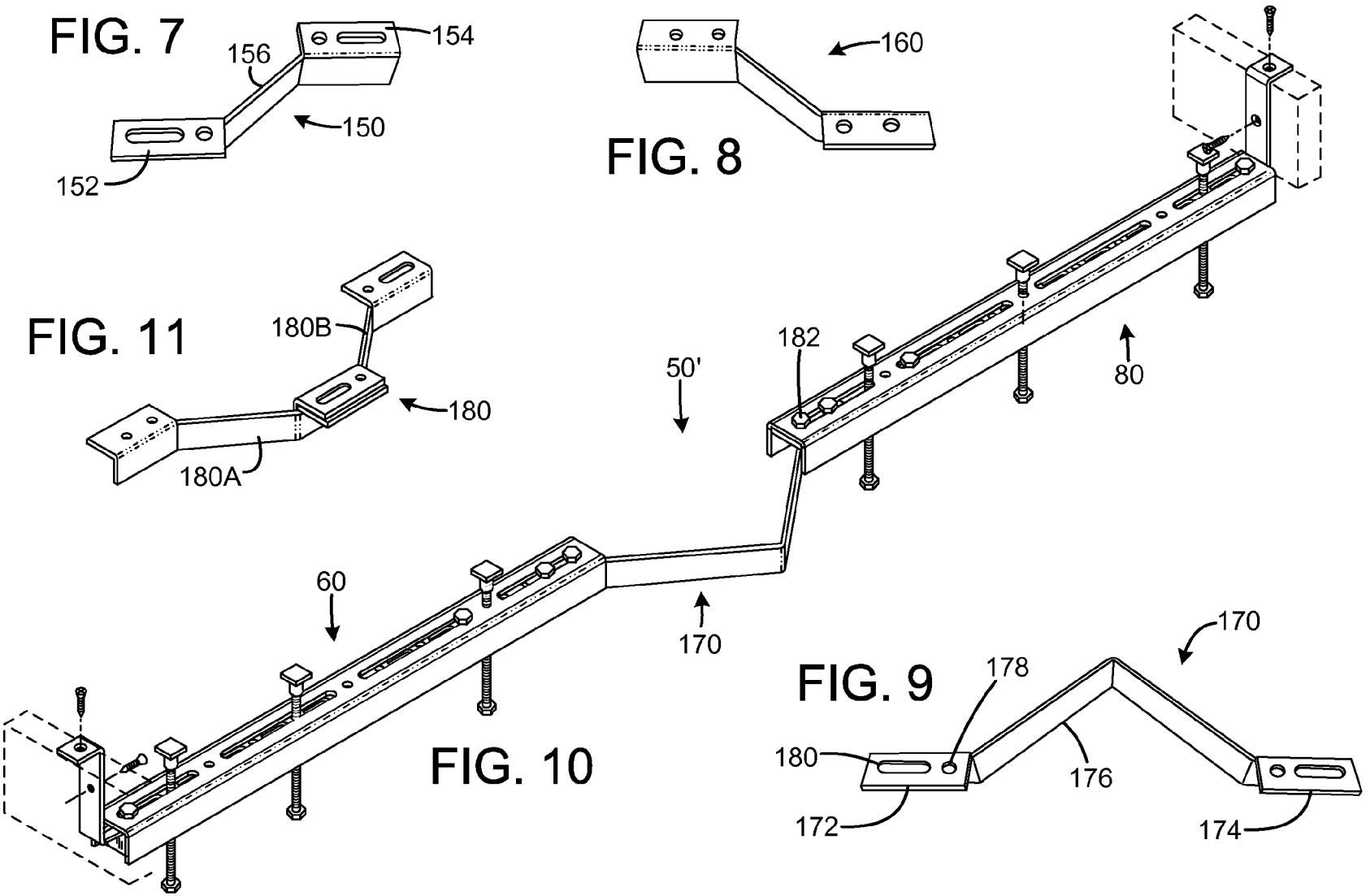
FIGS. 7 and 8 are an isometric view of exemplary alternate embodiments of an offset connector structure.
FIG. 9 is an isometric view of an exemplary embodiment of a V-shaped connector structure for a cross member bracket for a non-linear edge of a sink.
FIG. 10 is an isometric view of an exemplary embodiment of a cross-member bracket employing the connector structure of FIG. 9.
FIG. 11 is an isometric view of an alternate embodiment of a connector structure for a cross member bracket structure.

FIGS. 7-9 depict alternate embodiments of a connector structure for connecting the bracket structures 60 and 80 of a cross-member sink supporting structure. FIGS. 7-8 illustrate respective connector structures 150, 160, which in an exemplary embodiment may be fabricated of a sheet of metal material. Structure 150 has tab features 152, 154 at each end bent at right angles to the connector portion 156 to provide an attachment structure to attach to the bracket structures 60, 80, using threaded fasteners received in threaded bores and/or slots formed in the tab features 152, 154. Structure 160 has similar tab features. The structures 150, 160 are adapted to respectively connect to the bracket structures 60, 80 in only one direction. Structures 150, 160 may be mirror image structures, so that structure 150 may be used for connection in a first sense or direction, and structure 160 may be used for connection in a second sense or direction.

Figure 12:
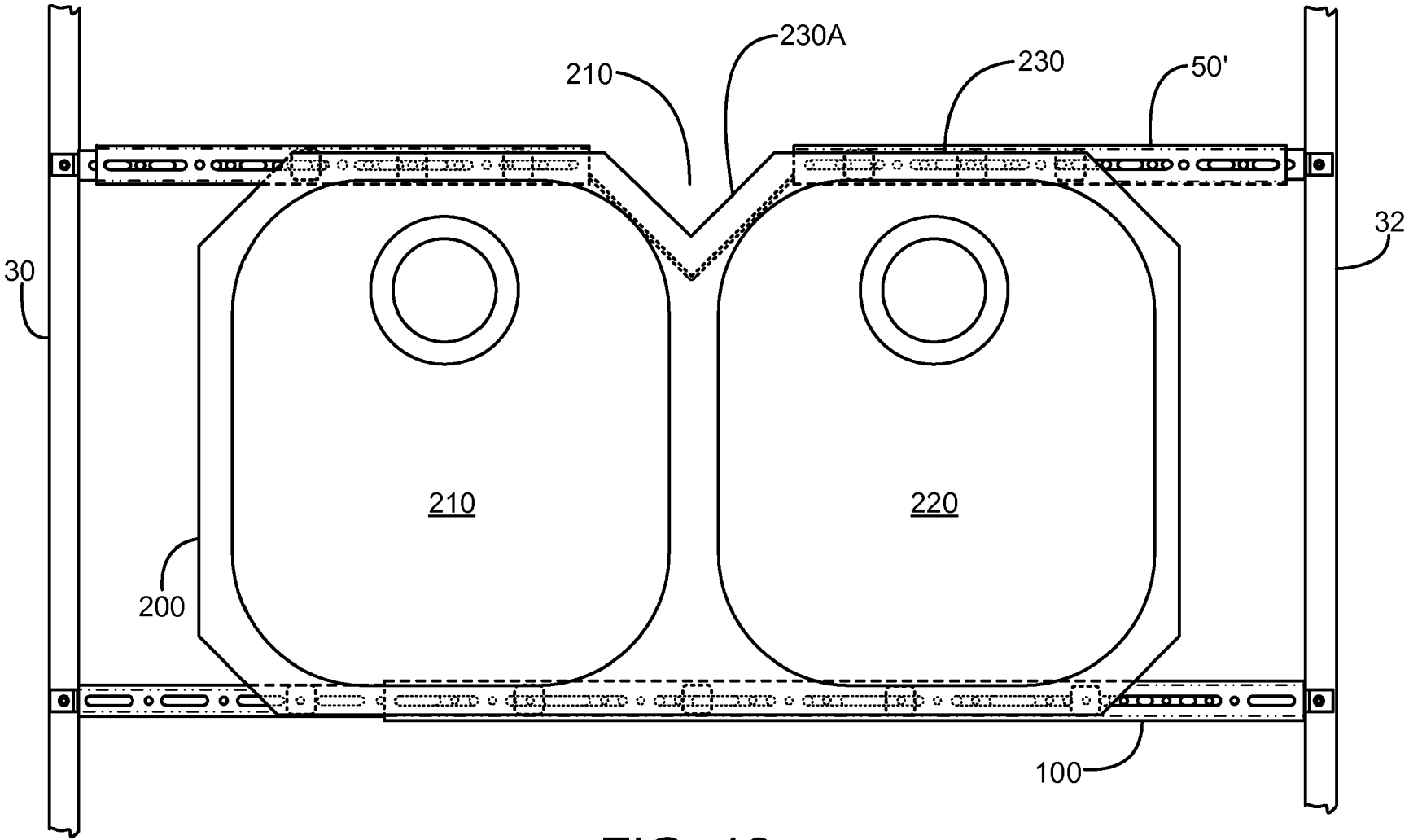
FIG. 12 is a top view of an exemplary embodiment of a double sink installation employing a cross-member bracket as depicted in FIG. 10.

The connector structures 150, 160 may be used to conform to non-linear sink lip portions similar to that depicted in the exemplary embodiment of FIG. 1, or in a reversed direction, i.e. with the small sink basin on the right side of the large sink basin. FIGS. 9-12 illustrate exemplary alternate embodiments of a connector structure for connecting to a different nonlinear mounting lip configuration of a sink. In this example, the connector structure 170 has a generally V-shaped connector portion 176, joining respective tab end portions 172, 174. The end portions may be used to attach to the bracket structures 60, 80 using threaded fasteners. A cross-member 50' with a V-shaped connector portion 170 as depicted in FIGS. 9-10 may be used in supporting a sink 200 as shown in FIG. 12. Here, the sink basins 210, 220 may be of the same size, but with a relieved portion 210 formed along one edge to provide an area in which a faucet assembly may be installed without interference with structure of the sink. To avoid interference with a sink cross-support member, a connector structure such as structure 170 may be employed.

FIG. 11 depicts an alternate embodiment of a connector structure 180 which may be used to connect bracket structures 60, 80, in a generally V-shaped configuration. The connector structure 180 includes two separate structures 180A, 180B, which may be assembled together using threaded fasteners.

Although the foregoing has been a description and illustration of specific embodiments of the subject matter, various modifications and changes thereto can be made by persons skilled in the art without departing from the scope and spirit of the invention as defined by the following claims.

What is claimed is:

1. A sink setting cross-member for supporting an edge of a sink having a non-linear sink edge and a linear edge portion relative to a support structure, the cross-member comprising:

a first attachment bracket portion at a first bracket end;

a second attachment bracket portion at a second bracket end;

a support portion disposed between the first attachment bracket portion and the second attachment bracket portion, said support portion including a non-linear support portion having a non-linear profile for conforming generally to said non-linear sink edge portion;

first and second linear bracket structure portions, the non-linear support portion disposed between said first and second linear bracket structure portions, said first and second linear bracket structure portions being telescoping bracket structure portions;

a plurality of threaded leveling devices adapted for engagement with respective threaded openings formed in said linear bracket structure portions and oriented to support at least the linear edge portion of the sink edge when the first and second attachment bracket portions are attached to the support structure.

2. The cross-member of claim 1, wherein:

said first bracket structure portion comprises a first bracket structure;

said second bracket structure portion comprises a second bracket structure;

said non-linear support portion having a first end attached to said first bracket structure and a second end attached to said second bracket structure.

3. The cross-member of claim 2, further comprising attachment means for attaching said first end of said non-linear support portion to said first bracket structure and for attaching said second end of said non-linear support portion to said second bracket structure.

4. The cross-member of claim 3, wherein said attachment means is further adapted for attaching said first end of said non-linear support portion to said second bracket structure and for attaching said second end of said non-linear support portion to said first bracket structure, and wherein said non-linear support portion is adapted for attachment to said first bracket structure and said second bracket structure in a first sense and in a reversed sense.

5. The cross-member of claim 1, configured to support an edge of an offset double sink including first and second sink basins, the second basin having a smaller depth dimension than said first basin, the first linear support portion and a first set of the plurality of leveling devices arranged to support a linear edge of the first sink basin, the second linear support portion and a second set of the plurality of leveling devices arranged to support a linear edge of the second sink basin.

6. The cross-member of claim 5, wherein said non-linear support portion is adapted to conform generally to a jog in the sink lip in a transition region between the first sink basin and the second sink basin.

7. The cross-member of claim 1, wherein at least one of said threaded openings is formed in said non-linear support portion.

8. The cross-member of claim 1, adapted to support an edge of a double sink including first and second sink basins, and said non-linear support portion has a generally V-shaped contour.

9. A sink setting device, comprising:

first and second telescoping bracket structures, each of said bracket structures including an upper channel member, a lower channel member and an attachment bracket portion;

a connector structure having a first connector end and a second connector end, said connector structure adapted for attachment between said first bracket structure and said second bracket structure;

wherein the connector structure has a non-linear profile, and said first bracket structure and said second bracket structure each have a linear profile;

a plurality of threaded leveling devices adapted for engagement with a respective threaded openings formed in said first and second telescoping bracket structures and oriented to support linear portions of the sink edge when the respective attachment bracket portions are attached to the support structure.

10. The device of claim 9, in which the leveling devices include a threaded bolt and a cap member for fitting over an end of the bolt.

11. The device of claim 9, further comprising attachment means for attaching said first connector end of said connector structure to said first bracket structure and for attaching said second connector end of said connector structure to said second bracket structure.

12. The device of claim 9, wherein said non-linear support profile is adapted to conform generally to a jog in a sink support surface.

13. The device of claim 9, further comprising a connector structure threaded opening formed in said connector structure and a threaded leveling device adapted for engagement with said connector structure threaded opening.

14. The device of claim 9, wherein said connector structure has a generally V-shaped contour.

15. The device of claim 9, wherein said connector structure is adapted for attachment in alternate directions, wherein in a first direction said first connector end is attached to said first bracket structure and said second connector end is attached to said second bracket structure, and in a second direction said first connector end is attached to said second bracket structure and said second connector end is attached to said first bracket structure.

16. A sink-setting system, comprising:

a first cross-member having a generally linear profile, and including a first support structure and first and second attachment brackets;

a second cross-member comprising:

first and second telescoping bracket structures, each of said bracket structures including an upper channel member and a lower channel member, said first bracket structure and said second bracket structure each having a linear profile;

a connector structure attached between said first bracket structure and said second bracket structure, said connector structure having a non-linear profile;

third and fourth attachment brackets for attachment to respective support structures;

a plurality of threaded leveling devices adapted for engagement with a respective threaded openings formed in said first said first and second telescoping bracket structures and oriented to support linear edge portions of the edges of the sink when the first, second, third and fourth attachment brackets are attached to the respective support structures.

17. The system of claim 16, in which the leveling devices include a threaded bolt and a cap member for fitting over an end of the bolt.

18. The system of claim 16, wherein said non-linear support profile is adapted to conform generally to a jog in a sink support surface.

19. The system of claim 16, wherein said connector structure has a generally V-shaped contour.

20. The system of claim 16, wherein said connector structure is adapted for attachment in alternate directions, wherein in a first direction a first connector end is attached to said first bracket structure and a second connector end is attached to said second bracket structure, and in a second direction said first connector end is attached to said second bracket structure and said second connector end is attached to said first bracket structure.

21. The cross-member of claim 9, configured to support an edge of an offset double sink including first and second sink basins, the second basin having a smaller depth dimension than said first basin, the first telescoping bracket structure and a first set of the plurality of leveling devices arranged to support a linear edge of the first sink basin, the second telescoping bracket structure and a second set of the plurality of leveling devices arranged to support a linear edge of the second sink basin.

22. The system of claim 16, configured to support an edge of an offset double sink including first and second sink basins, the second basin having a smaller depth dimension than said first basin, the first telescoping bracket structure and a first set of the plurality of leveling devices arranged to support a linear edge of the first sink basin, the second telescoping bracket structure and a second set of the plurality of leveling devices arranged to support a linear edge of the second sink basin.

* * * * *